US010864965B2

(12) United States Patent
Alexander

(10) Patent No.: US 10,864,965 B2
(45) Date of Patent: Dec. 15, 2020

(54) TENSION HELD COVER

(71) Applicant: Dowco, Inc., Manitowoc, WI (US)

(72) Inventor: Jon Alexander, Manitowoc, WI (US)

(73) Assignee: Dowco, Inc., Manitowoc, WI (US)

( * ) Notice: Subject to any disclaimer, the term of this patent is extended or adjusted under 35 U.S.C. 154(b) by 0 days.

(21) Appl. No.: 16/286,895

(22) Filed: Feb. 27, 2019

(65) Prior Publication Data

US 2019/0193815 A1 Jun. 27, 2019

Related U.S. Application Data

(63) Continuation of application No. 14/607,802, filed on Jan. 28, 2015, now Pat. No. 10,336,406.

(60) Provisional application No. 61/933,188, filed on Jan. 29, 2014.

(51) Int. Cl.
*B63B 17/02* (2006.01)

(52) U.S. Cl.
CPC ..... *B63B 17/02* (2013.01)

(58) Field of Classification Search
CPC ..... B63B 17/02
USPC ..... 150/154–168; 114/361, 364, 351; 296/100, 16, 100.17
See application file for complete search history.

(56) References Cited

U.S. PATENT DOCUMENTS 2,570,533 A * 10/1951 Elliott ..... B60J 11/00 150/166
2,571,362 A 10/1951 Hervey
2,646,097 A 7/1953 Gaverth
2,821,989 A 2/1958 Harwood
3,059,659 A * 10/1962 Ipsen ..... B63B 17/02 135/115
3,354,892 A 11/1967 Frieder
3,399,687 A 9/1968 Frieder
3,489,452 A 1/1970 Plante
3,698,409 A 10/1972 Koontz
4,075,723 A 2/1978 Bareis
5,303,667 A 4/1994 Zirkelbach
5,479,872 A 1/1996 Hulett
5,522,409 A 6/1996 May
5,697,320 A 12/1997 Murray
5,706,752 A 1/1998 Menne, Jr.
5,743,208 A 4/1998 Miller
5,803,104 A 9/1998 Pollen
5,901,657 A 5/1999 Schwartz
5,941,594 A 8/1999 O'Neill
(Continued)

FOREIGN PATENT DOCUMENTS

FR 2753166 3/1998
JP 2007009589 1/2007

OTHER PUBLICATIONS

Website screenshot: https://web.archive.rg/web/20131108112133/http://www.canvas-boat-cover-and-repair-advisor.com/boat-cover-supports.html, Nov. 8, 2013.

(Continued)

*Primary Examiner* — Sue A Weaver
(74) *Attorney, Agent, or Firm* — Shane Delsman; Godfrey & Kahn, S.C.

(57) ABSTRACT

A cover for a vehicle, such as a boat, including a ratchet and straps. The straps are connected to a plate for evenly distributing the load placed on the straps when the straps are tightened by the ratchet. The straps, when tightened, provide form to the cover such that water will run off the cover.

24 Claims, 20 Drawing Sheets

(56) References Cited

U.S. PATENT DOCUMENTS

| | | | | |
|---|---|---|---|---|
| 6,006,692 | A | 12/1999 | Szukhent, Jr. | |
| 6,129,034 | A | 10/2000 | Santa Cruz et al. | |
| 6,209,477 | B1 | 4/2001 | Biedenweg | |
| 6,637,364 | B1 | 10/2003 | Campeau | |
| 6,666,163 | B2 | 12/2003 | Pastor | |
| 6,672,241 | B2 | 1/2004 | Warfel | |
| 6,789,495 | B2 | 9/2004 | Brower et al. | |
| 6,983,716 | B1 | 1/2006 | Ankney | |
| 7,063,035 | B2 | 6/2006 | Belcher | |
| 7,107,926 | B2 | 9/2006 | Fishburn | |
| 7,204,466 | B2 | 4/2007 | Hsieh | |
| 7,418,919 | B2 | 9/2008 | Smith et al. | |
| 7,430,981 | B2 | 10/2008 | Malcore | |
| 7,458,333 | B2 * | 12/2008 | Yang | B60J 7/104 114/361 |
| 7,536,971 | B1 | 5/2009 | Fry | |
| 7,571,691 | B2 | 8/2009 | Russikoff | |
| 7,950,342 | B2 | 5/2011 | Russikoff | |
| 8,418,708 | B2 | 4/2013 | Benish | |
| 8,616,511 | B2 | 12/2013 | James | |
| 8,752,498 | B1 | 6/2014 | Schwindaman | |
| 8,875,646 | B2 | 11/2014 | Zirkelbach et al. | |
| 8,950,416 | B1 | 2/2015 | Spellman | |
| 2008/0066794 | A1 | 3/2008 | Durfee | |
| 2009/0293797 | A1 | 12/2009 | Kent | |
| 2010/0083691 | A1 | 4/2010 | Russikoff | |
| 2011/0290170 | A1 | 12/2011 | Russikoff | |
| 2014/0026803 | A1 | 1/2014 | Musacchio | |
| 2015/0047550 | A1 | 2/2015 | Zirkelbach | |
| 2015/0166144 | A1 | 6/2015 | Langley | |
| 2015/0210150 | A1 | 7/2015 | Alexander | |
| 2016/0129974 | A1 | 5/2016 | Hough | |
| 2017/0057600 | A1 | 3/2017 | Hough | |

OTHER PUBLICATIONS

Website screenshot; https://web.archive.org/web/20131020233755/http://www.wayfair.com/Navigloo-19-t0-22%C2%BD-ft-Storage-System-Fishing-Runabout-with-Tarpaulin-Cover-3370-NAVI1004.html; Oct. 20, 2013.

Website screenshot; https://www.youtube.com/watch?v=-1jGOfijIVM; published Dec. 12, 2013.

Website screenshot; https://web.archive.org/web/20120820000834/http://www.websweeper.com/php/boat_covers/bc-018.php; Aug. 20, 2012.

Website screenshot; https://web.archive.org/web./20130925032949/http://www.outdoorfabricscanada.com/Vents-Mooring-Supports_c_304.html; Sep. 25, 2013.

https://www.youtube.com/watch?v=kanacQovuzU; Dec. 10, 2013; Side-Winder Pontoon Roll cover Demonstration.

* cited by examiner

TENSION HELD COVER

CROSS REFERENCE TO RELATED APPLICATION

This continuation application claims the benefit of and priority to Ser. No. 14/607,802, filed Jan. 28, 2015, which claims the benefit of and priority U.S. Provisional Patent Application Ser. No. 61/933,188, filed Jan. 29, 2014, the disclosures of which are hereby incorporated by reference herein in their entirety for all purposes.

FIELD OF THE INVENTION

The present invention relates generally to the field of vehicles such as boats. More particularly, the present invention relates to covers for such vehicles.

BACKGROUND

Vehicles require upkeep and maintenance. One example of such maintenance is the frequent activity of uncovering and covering a boat or automobile, such as before and after use. Generally, covers must be sized such that they are larger than the structure they are designed to cover. This allows the cover to be more easily put on a vehicle. After the cover is added to a boat or other vehicle, support must be given to the cover so that it does not have slack or otherwise have slumps where water could build up and pool. The cover must also be given shape so that the water runs towards and off the sides of the vehicle.

Current methods of adding tension, support and/or shape to a cover, for example on a boat, rely on poles that must be installed under the cover. This is usually done after the cover is partially attached. Subsequent movement of the cover, such as by wind or trailer movement, can cause the poles to become dislodged. Once a single pole or vent has been dislodged or lost, the cover will not perform its job. As a result, water can collect on the cover and lead to stretching, deformed appearance, damage, leaks or reduction of the useful life of the cover, and also water entering the area for which protection is desired.

In order to install support poles, someone must go inside the boat or vehicle and under the cover. Therefore, the person installing the support poles must crawl around, in the dark, trying to set up the poles without disturbing the poles that are already set up.

The boating industry includes many recreational users. Recreational users may choose to leave such covers off entirely so as to avoid the frustration, discomfort and time required to set up support poles under the cover. This results in accelerated wear and damage to the boat.

As such, there is a need for a cover that does not require a support pole or other such unstable structure to provide support and is easy to install on a boat.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

SUMMARY OF THE INVENTION

In one embodiment, the invention provides a covering for a vehicle with an elevated structure. The covering includes a fabric sized to cover at least a portion of the vehicle, a securing means coupled to the fabric for securing the fabric to the vehicle, and a tightening means coupled to the fabric for creating a generally taut fabric. When the fabric is taut, the fabric forms generally inclined surfaces with low points where the fabric is secured to the vehicle and at least one high point at the elevated structure such that water will run off the fabric and at least one side of the vehicle.

In another embodiment, the invention provides a cover for a boat having an interior, a walk through windshield and a contour edge. The cover includes a cover material sized to cover the interior, a pulley, a strap and a ratchet. The cover material has a first guide and a second guide. The strap extends through the pulley and is connected to the boat at each end of the strap and operatively joined to the cover material through the first guide and second guide. The ratchet is connected to the strap and configured to tighten the strap. When the strap is tightened, the cover material becomes substantially tensioned and creates at least one path for water to move away from a portion of the cover material covering the walk through windshield and towards the contour edge.

In another embodiment, the invention provides a vehicle covering. The vehicle covering includes a cover material, a plate attached to the vehicle covering, first, second and third ropes, and a ratchet. The first rope is connected to the plate and to a vehicle at a first location. The second rope connected to the plate and to the vehicle at a second location. The third rope connected to the plate and to the vehicle at a third location. The ratchet tights the first, second and third ropes to give form to the cover material such that water will run off the cover material.

In another embodiment, the invention provides a cover for covering a bow of a boat having a starboard side, port side and nose. The cover includes a fabric sized to cover the bow and has starboard and port sides. A first skirt is attached to the starboard side of the fabric and has at least a first fastener. A second skirt is attached to the port side of the fabric and has at least a second fastener. An enclosure is formed at least by a portion of the fabric sized to at least partially enclose the nose. When the nose is at least partially enclosed by the enclosure, the first fastener can be used to secure the fabric to the starboard side of the bow and the second fastener can be used to secure the fabric to the port side of the bow.

In another embodiment, the invention provides a covering for a vehicle with an elevated structure. The covering includes a fabric sized to cover at least a portion of the vehicle, a securing means coupled to the fabric for securing the fabric to the vehicle, and a tightening mechanism coupled to the fabric for creating a generally taut fabric. When the fabric is taut, the fabric forms generally inclined surfaces with low points where the fabric is secured to the vehicle and at least one high point at the elevated structure such that water will run off the fabric and at least one side of the vehicle.

BRIEF DESCRIPTION OF THE DRAWINGS

FIG. 14B is an enlarged bottom plan view of a portion of the cover of FIG. 14 indicated by the line 14A showing on example of another alternative mechanism known in the prior art.

DETAILED DESCRIPTION

Figure 1:
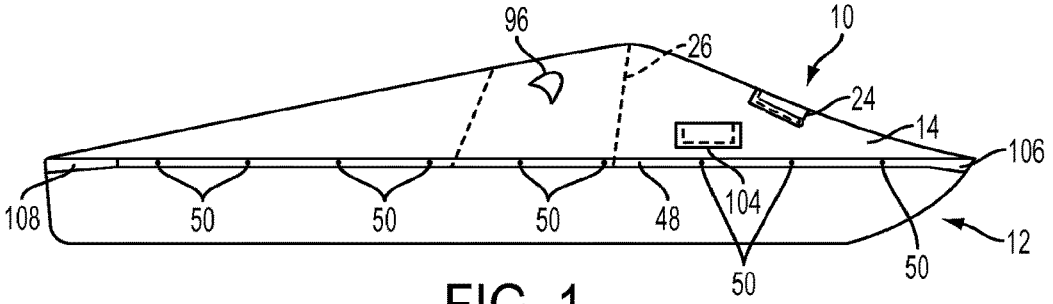
FIG. 1 is an elevation view of a boat with a cover in accordance with one embodiment of the invention.
Figure 2:
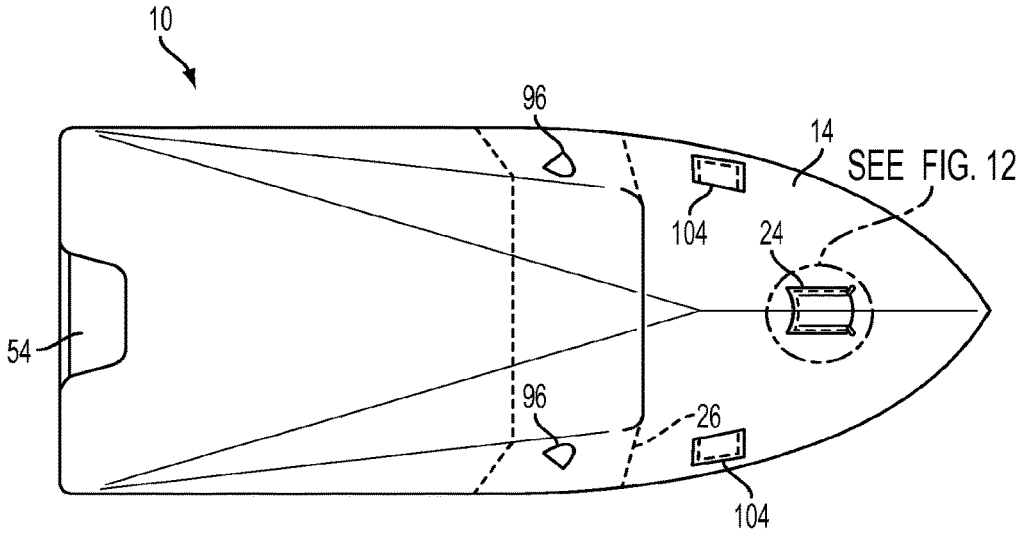
FIG. 2 is a top plan view of a boat with the cover of FIG. 1.
Figure 3:
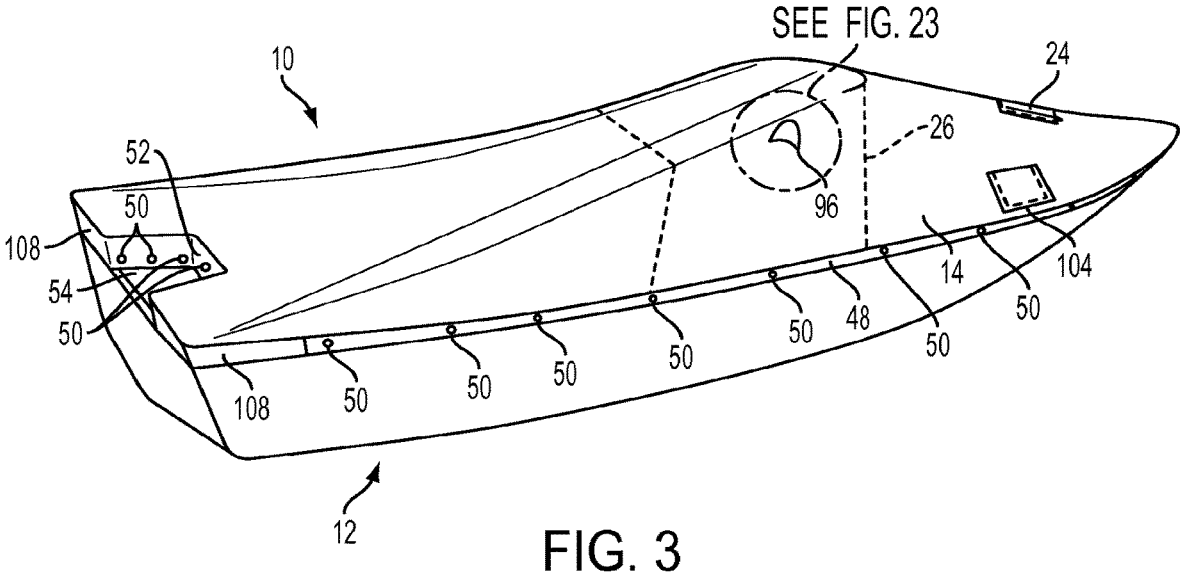
FIG. 3 is a perspective view of a boat with the cover of FIG. 1.

A cover or covering for a vehicle in accordance with the present invention is easy to put on a vehicle and tightened to add tension and give form to the cover avoiding the need for support poles. For example, as seen in FIGS. 1-3, one embodiment of a cover 10 can be added to a marine vehicle such as a boat 12.

The cover 10 generally includes a securing means for attaching the cover to the boat, for example, and a tensioning means such that after the cover is attached to the boat 12, the cover can be tightened and/or tensioned, thereby giving the cover support and form. The tensioning means could be located under a sheet of fabric cover material 14, such that the fabric cover material rests on top of the tensioning means, or above the fabric cover material, such that the fabric cover material depends from the tensioning means. The sheet of fabric cover material 14 could be formed from a single piece of fabric cover material or could be comprised of a number of pieces of fabric cover material attached, for example, by being sewn together.

Figure 4:
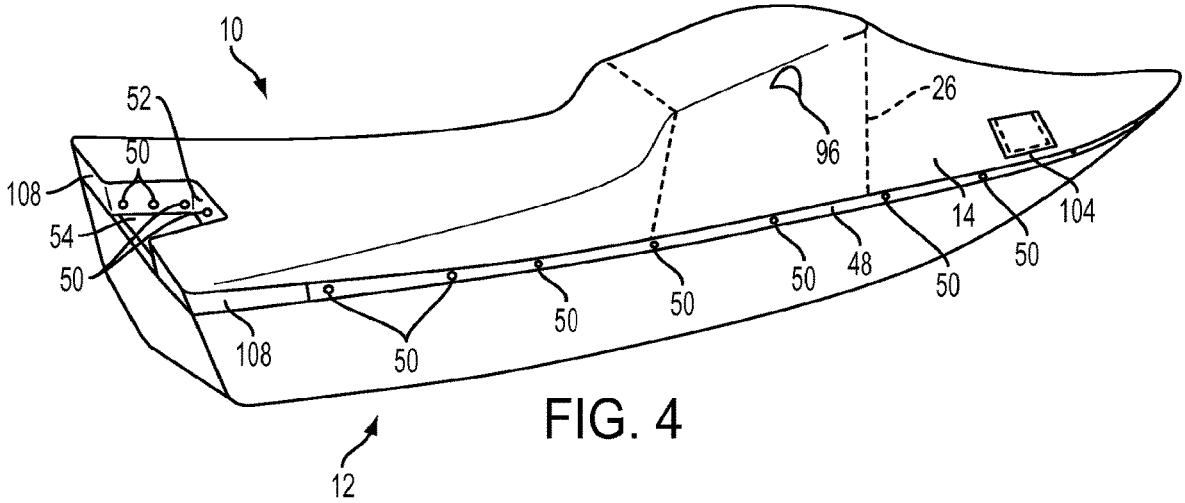
FIG. 4 is a perspective view of a boat with the cover of FIG. 1 in an untensioned state.
Figure 5:
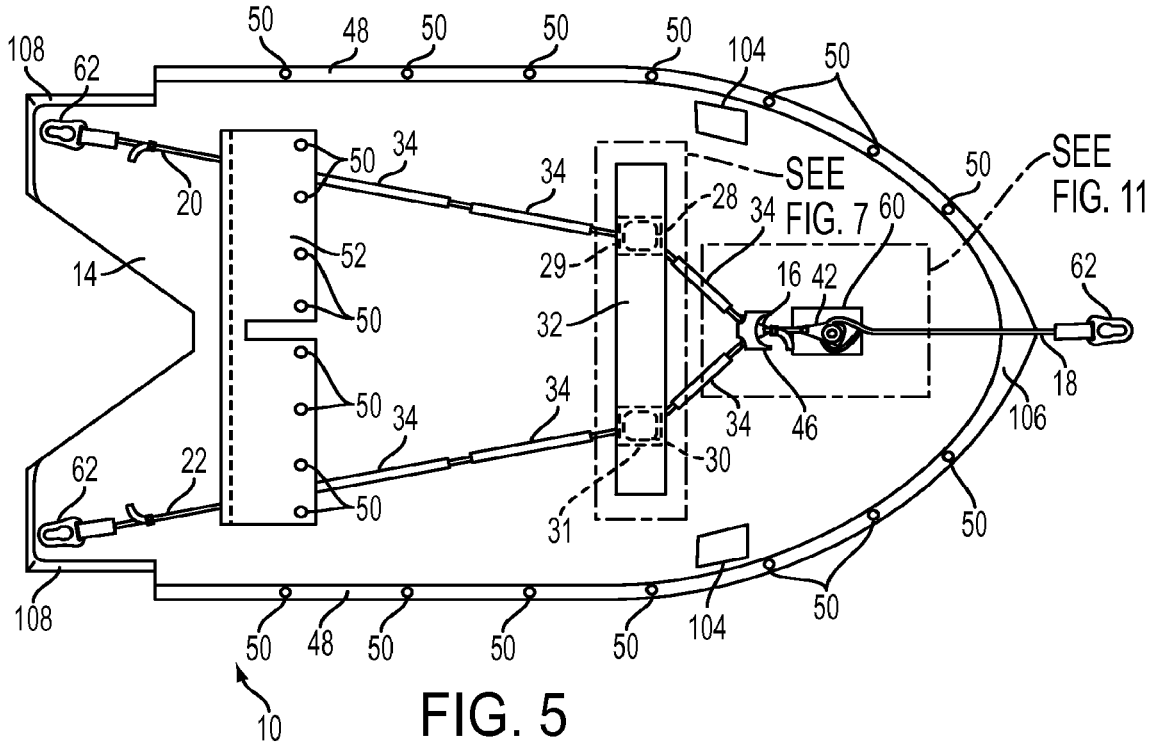
FIG. 5 is a bottom plan view of the cover of FIG. 1.
Figure 6:
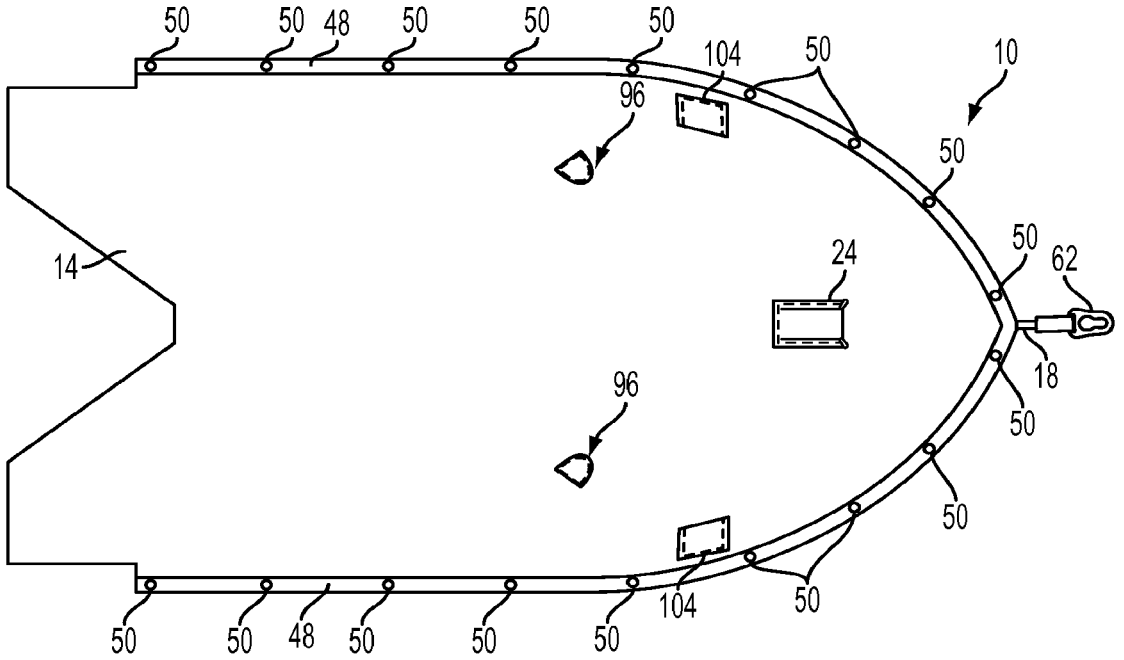
FIG. 6 is a top plan view of the cover of FIG. 1.

In the embodiment shown in FIG. 5, the cover 10 includes a tensioning means on the underside of the fabric cover material 14. The tensioning means shown in FIG. 5 includes a series of ropes, straps, webs or other cord type structures. In FIG. 5, the series of ropes are each connected at one end to a spreader plate 16, such as, for example by ladder locks, and to the boat 12 at their second or other end by a fastener. For example, a first rope 18 is attached at its second end to the nose of the boat 12 and the second end of the second and third ropes 20, 22 are attached to the starboard and port side stern corners of the boat, respectively, by a fastener. Because the cover 10 is not tightened until after it is secured to the boat 12, as seen in FIG. 4, each of the ropes 18, 20, 22 are easily secured in place and the cover properly positioned.

A tightening mechanism or device is also included in the tensioning means, such as a ratchet, winch, gearing, pulley, buckle, rings, or other mechanisms for tightening a strap or rope known in the industry. After the series of ropes are connected to the boat 12, the tightening mechanism allows the series of ropes to be tightened thereby adding tension to and giving the cover 10 form, for example a number of inclined surfaces. As seen in FIGS. 2, 6 and 11-12, the tightening mechanism may be accessible through an access panel 24.

As seen in FIGS. 1-3, the second and third ropes 20, 22 run over the windshield 26 of the boat 12 to provide a high point of the cover 10 and help give form to the cover. The perimeter of the boat 12 provides low points of the cover. Thus, when water is on the cover 10, such as when towing a boat through rain, the water will run from a high point, windshield 26, to the low point, perimeter or contour edge of the boat, and run off the boat. Instead of having support poles between the windshield 26 and the sides of the boat 12 to support the cover 10, in FIGS. 1-3, the cover is supported by the series of ropes which are under tension from the tightening mechanism.

When tension is added to the second and third ropes 20, 22 such as by the tightening mechanism, a large amount of that tension will be transferred to the windshield 26. In order to prevent point loading on the windshield 26, and thereby increasing the risk of cracking or otherwise damaging the windshield, a pad or plate 28, 30 is added between the second and third ropes 20, 22 and the windshield, respectively, as seen most clearly in FIG. 7. The pads 28, 30 could be made from a high-density polyethylene. However, other materials for dispersing a point load are known in the industry, for example nylon, the use of which would not defeat the spirit of the invention.

In order to prevent wear on the windshield 26, such as from rubbing by the second and third ropes 20, 22, a guard 32 is attached to the fabric cover material 14 over the pads 28, 30 in the area of the windshield. This guard 32 allows the second and third ropes 20, 22 to slide without damaging the windshield 26, such as, for example when installing the ropes and tightening the series of ropes down. The guard 32 could be made from a vinyl coated polyvinyl chloride material (aka PVC) or a non-woven material (e.g. felt). However, other materials for protecting a structure from wear or other damage due to sliding are known in the art, the use of which would not defeat the spirit of the invention. The cover could also include a shield that has a guard 32 enclosing one or more pads 28, 30 between the guard and fabric cover material 14 and a passageway between the one or more pads and fabric cover material for passage of the second and third ropes 20, 22.

Figure 7:
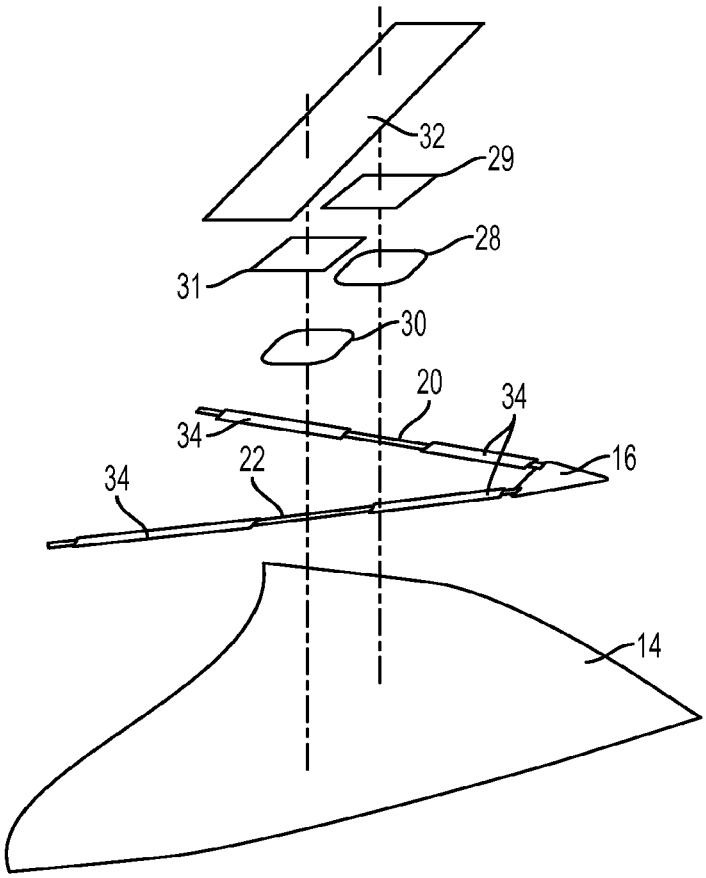
FIG. 7 is an enlarged, exploded perspective view of a portion of the cover of FIG. 5.

In the embodiment shown in FIGS. 5 and 7, the pads have a buffer 29, 31 between each of the pads 28, 30 and the guard 32. The buffers 29, 31 help prevent the pads 28, 30 from cutting through or puncturing the guard 32 due to the loads placed on the pads by the straps 20, 22. The buffers can be made from a polyvinyl chloride material (aka truck tarp). However, other materials for preventing one material from cutting through another material are known in the industry, for example polyethylene or polyester, the use of which would not defeat the spirit of the invention.

On boats 12 with a walk-through windshield 26, the walk-through door is the weakest part of the windshield structure. In order to protect the walk-through portion of the windshield 26, the spreader plate 16 is triangular in shape to direct the second and third ropes 20, 22 so as to contact the windshield outside of the walk through door. The spreader plate 16 is also shaped such that when the tightening mechanism is used to tighten the second and third ropes 20, 22, the load is distributed between the second and third ropes 20, 22 substantially equally. Although the spreader plate 16 disclosed in FIG. 7 is triangular in shape, alternative shapes and methods, such as for example a spreader bar, could be used to spread the load equally between second and third ropes 20, 22.

In the covering embodiment shown in FIG. 5, the securing means also includes attaching or coupling the second and third ropes 20, 22 to the fabric cover material 14, such as through guides. For example, as seen in FIG. 5, the second and third ropes 20, 22 are attached to the fabric cover material by a first series and second series of sleeves 34, respectively. In another embodiment shown in FIG. 8, the second and third ropes 20, 22 are attached to the fabric cover material by a first series and second series of loops 38, respectively. As previously described, although the first series and second series of sleeves 34, are shown located on the underside of the fabric cover material 14, they could also be located on the upper side of the fabric cover material without defeating the spirit of the invention.

Figure 9:
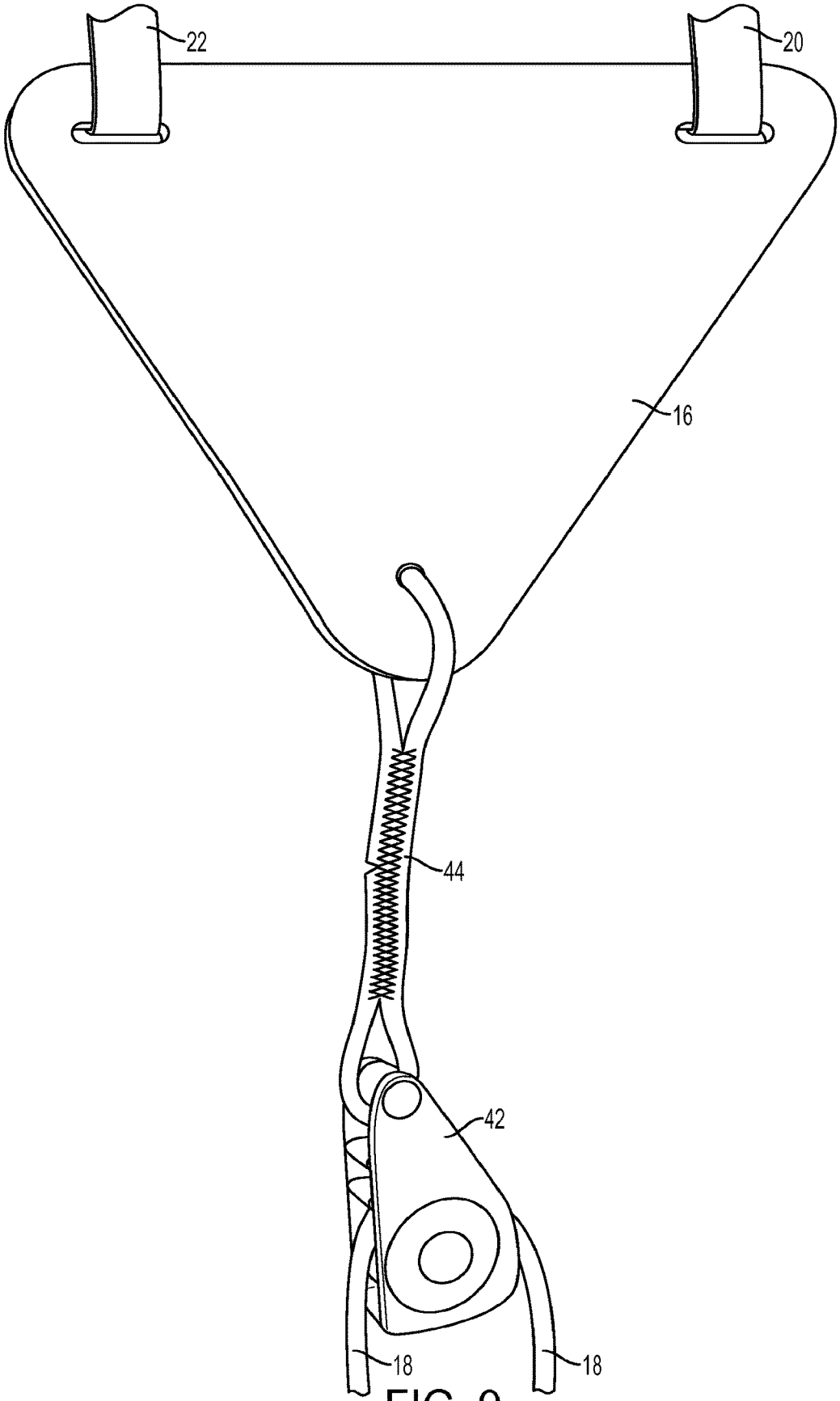
FIG. 9 is an enlarged perspective view of a spreader plate and tightening mechanism.
Figure 10:
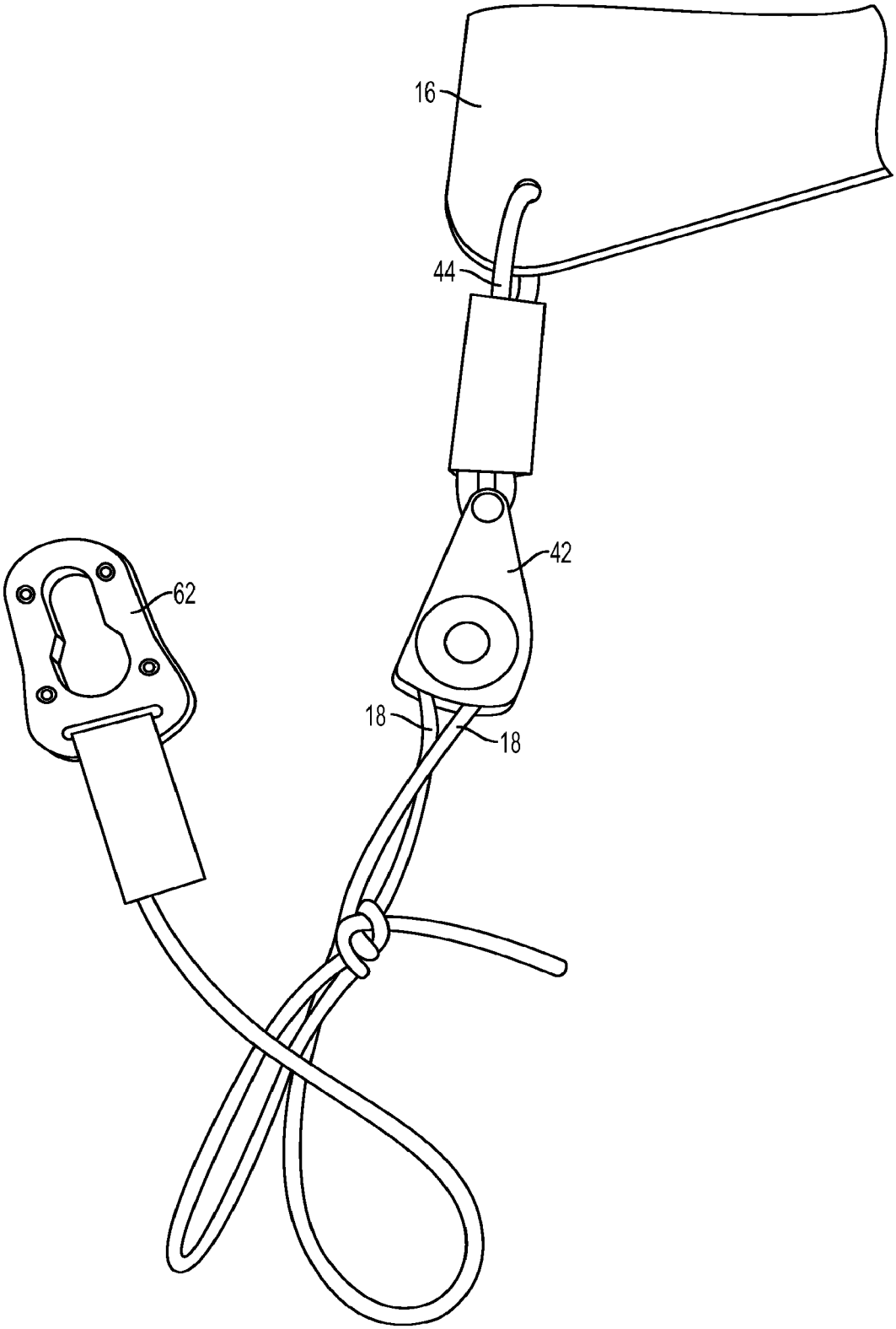
FIG. 10 is an enlarged perspective view of a strap and ratchet of a cover.

The tightening mechanism shown in FIG. 5 is a ratchet 42. As seen most clearly in FIGS. 9-10, the first rope 18 is attached to the ratchet 42 and the ratchet is attached to the spreader plate 16 by, for example, a reinforced cord 44. As the first rope 18 is pulled through the ratchet 42, the portion of the first rope between the spreader plate 16 and the nose of the boat 12 becomes shorter. In the cover embodiment seen in FIG. 11, the spreader plate 16 is attached to the fabric cover material 14 via an enclosed pocket 46. As the spreader plate 16 is pulled towards the nose of the boat 12, so too is the fabric cover material 14 via the spreader plate's attachment to the fabric cover material in the enclosed pocket 46 and the second and third ropes 20, 22 are tightened or tensioned. As the second and third ropes 20, 22 start to become tightened, the ropes and fabric cover material 14 will raise off the boat 12 and be taut and supported with little to no visible sagging, thereby giving the cover 10 support and form.

Figure 8:
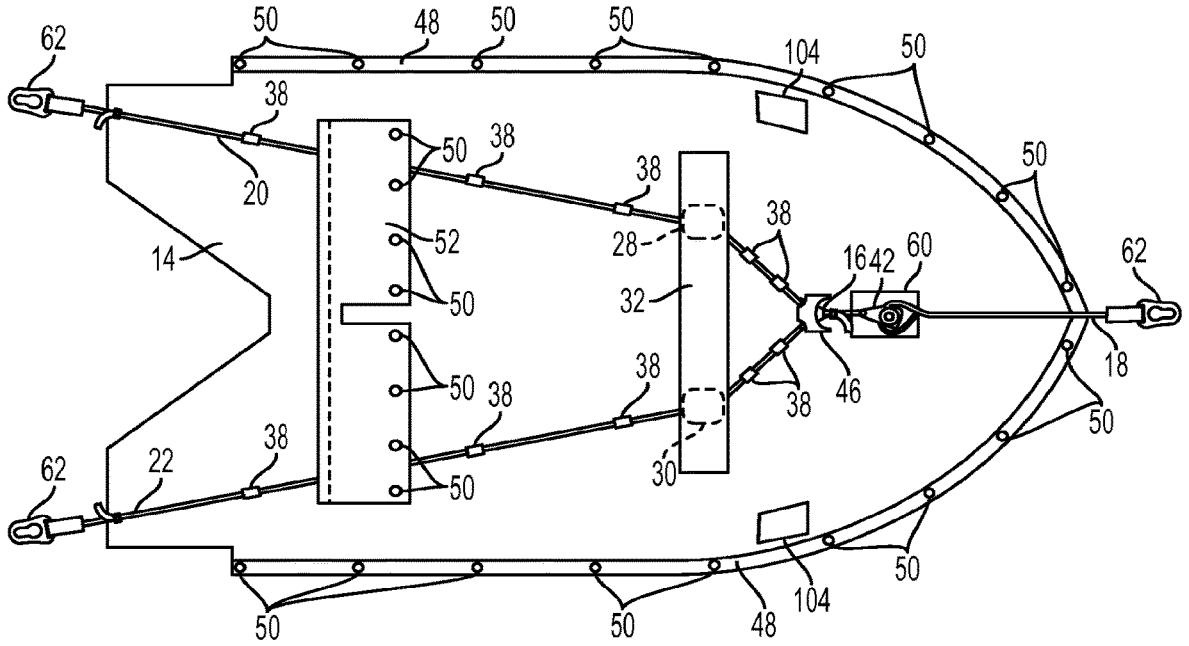
FIG. 8 is a plan view of the bottom side of an alternative embodiment of a cover.

The ropes hold the cover 10 to the boat at the connection locations and give form to the cover enabling water to effectively run off the covered boat. Once the ropes are appropriately tightened, the perimeter flap 48 of the cover 10 can be secured to the boat 12 using an attaching means provided with the cover. For example, as seen in FIG. 8, the perimeter flap 48 includes a number of snaps 50 that mate with snaps (not shown) located in the channel 36 of a gunnel rail 40 of a boat 12. The perimeter flap 48 wraps the fabric cover material 14 around the edge or gunnel rail of the boat 12 such that water will run away from the windshield 26 of the boat and off the sides of the boat. Similarly, the cover 10 can include a motor well flap 52. When the cover 10 is attached to the boat 12, the motor well flap 52 is used to at least partially enclose the motor well 54 of the boat as is seen in FIGS. 2-3. When water runs off of the cover 10 towards the motor well 54, the motor well flap 52 prevents water from accessing the interior of the boat 12 by directing the water into the motor well 54. Because motor wells typically have drain holes, the water directed into the motor well 54 will simply drain out.

Figure 12:
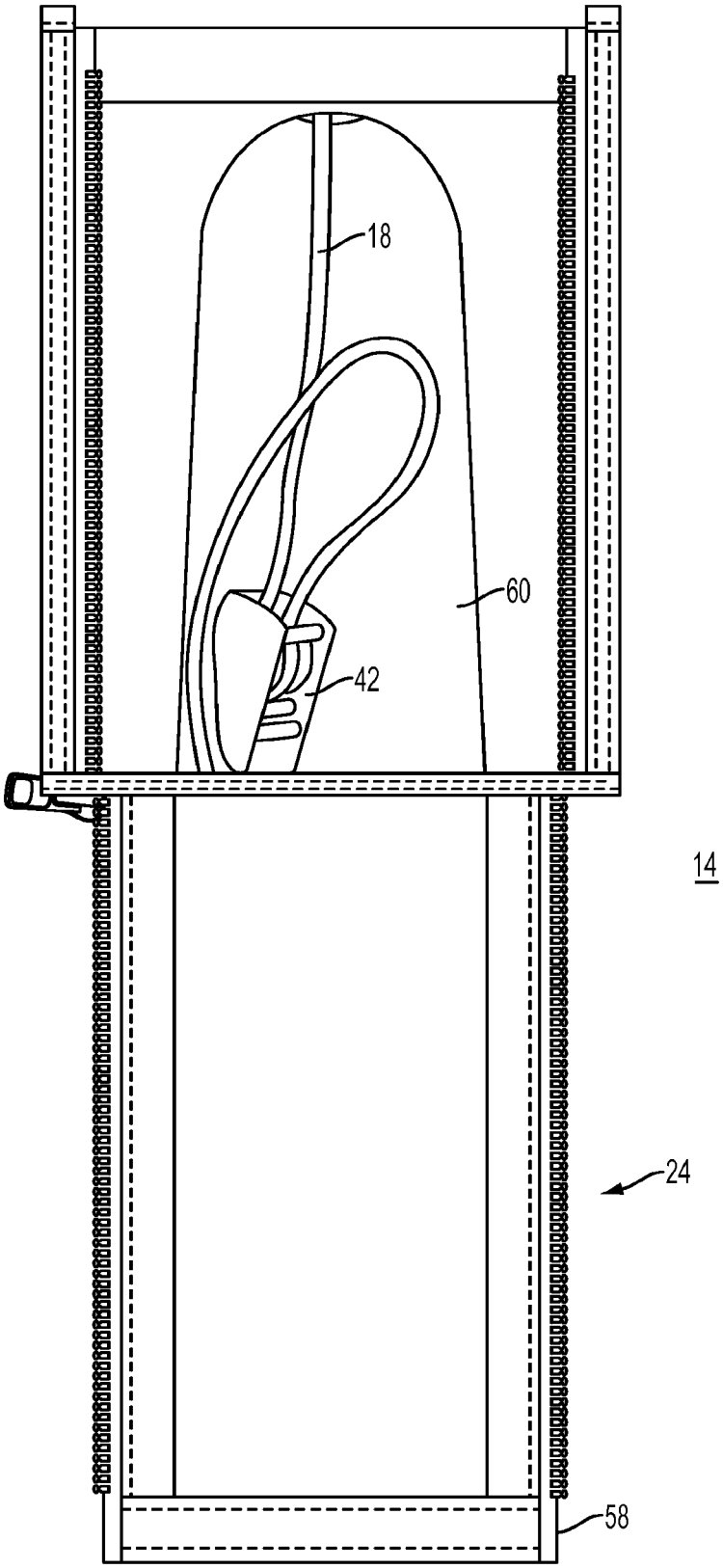
FIG. 12 is an enlarged top plan view of the access panel of FIG. 5.

The ratchet 42 may be accessed by an access panel 24. The access panel 24 shown in FIG. 12 includes a zippered access flap 58 that exposes an access opening 60 in the fabric cover material 14 and, thereby, access to the ratchet 42. When it is desired to tighten or untighten the cover 10, the access panel 24 may be opened and the ratchet 42 operated. While the access panel 24 shown in FIG. 12 shows a zippered embodiment, other releasable closure means, such as for example hooks and loops, snaps, zippers, buttons, etc. are known in the art, the use of which would not defeat the spirit of the invention.

Figure 11:
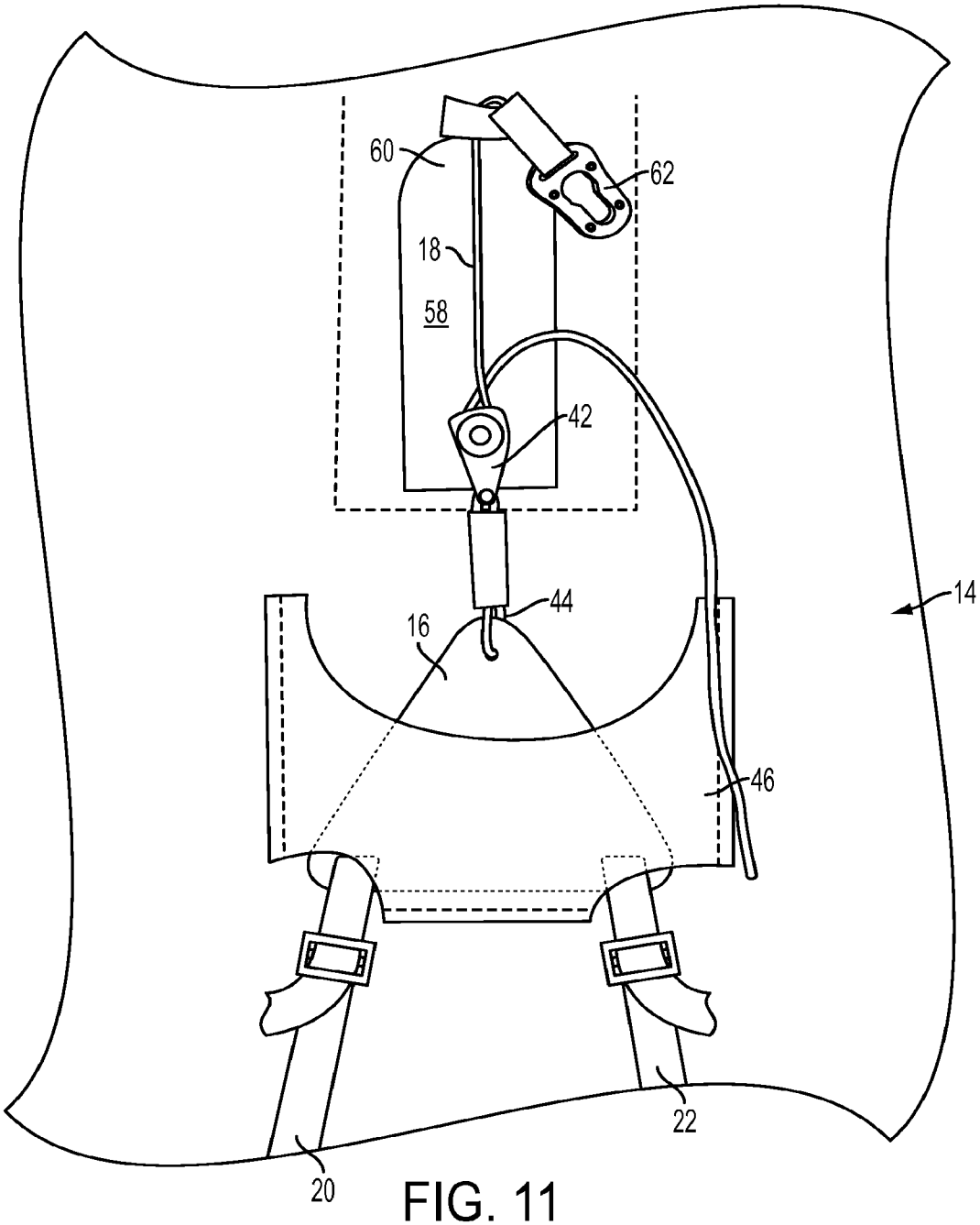
FIG. 11 is an enlarged bottom plan view of the pocket of FIG. 5.
Figure 13:
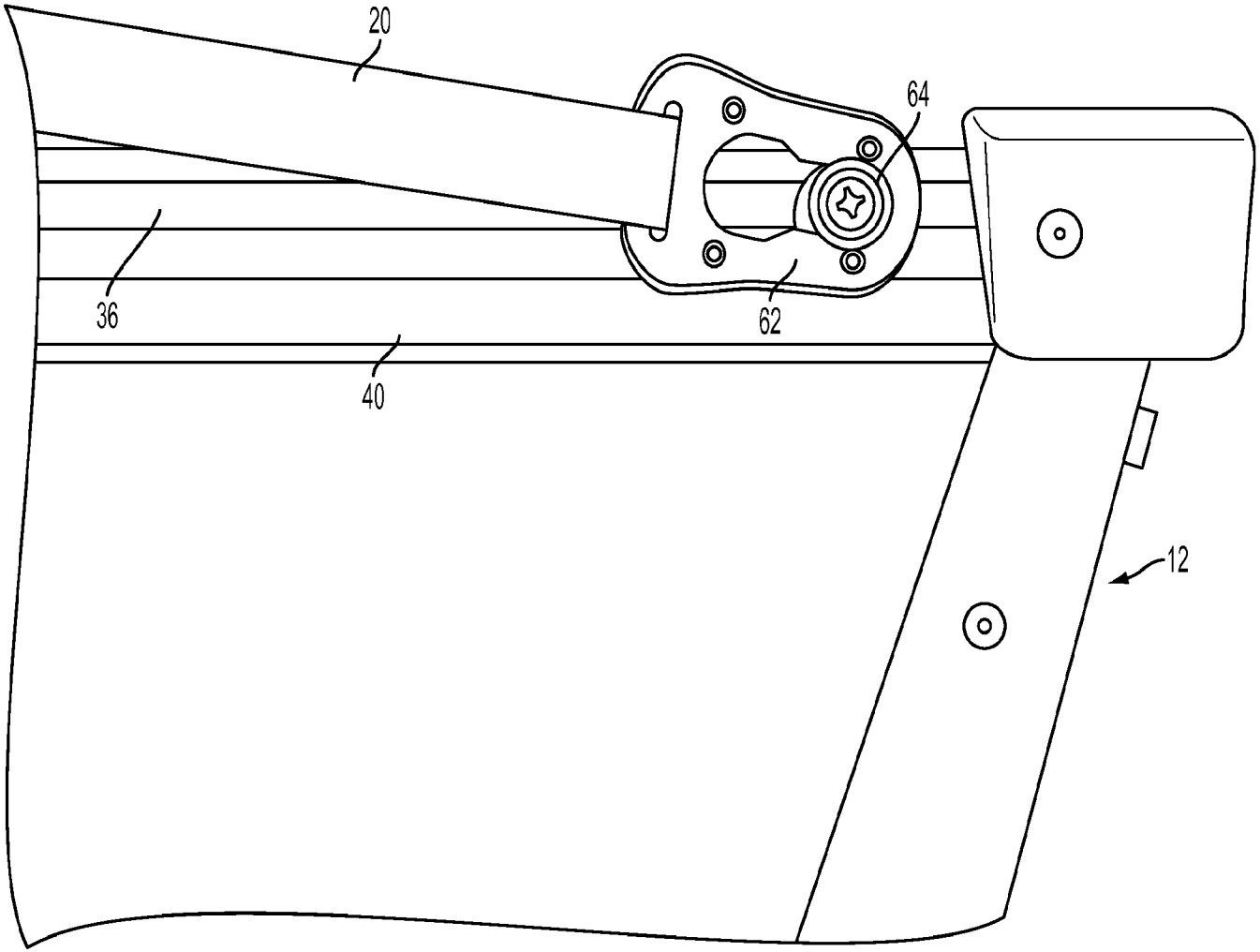
FIG. 13 is an enlarged elevation view of a strap connected to a boat.
Figure 14:
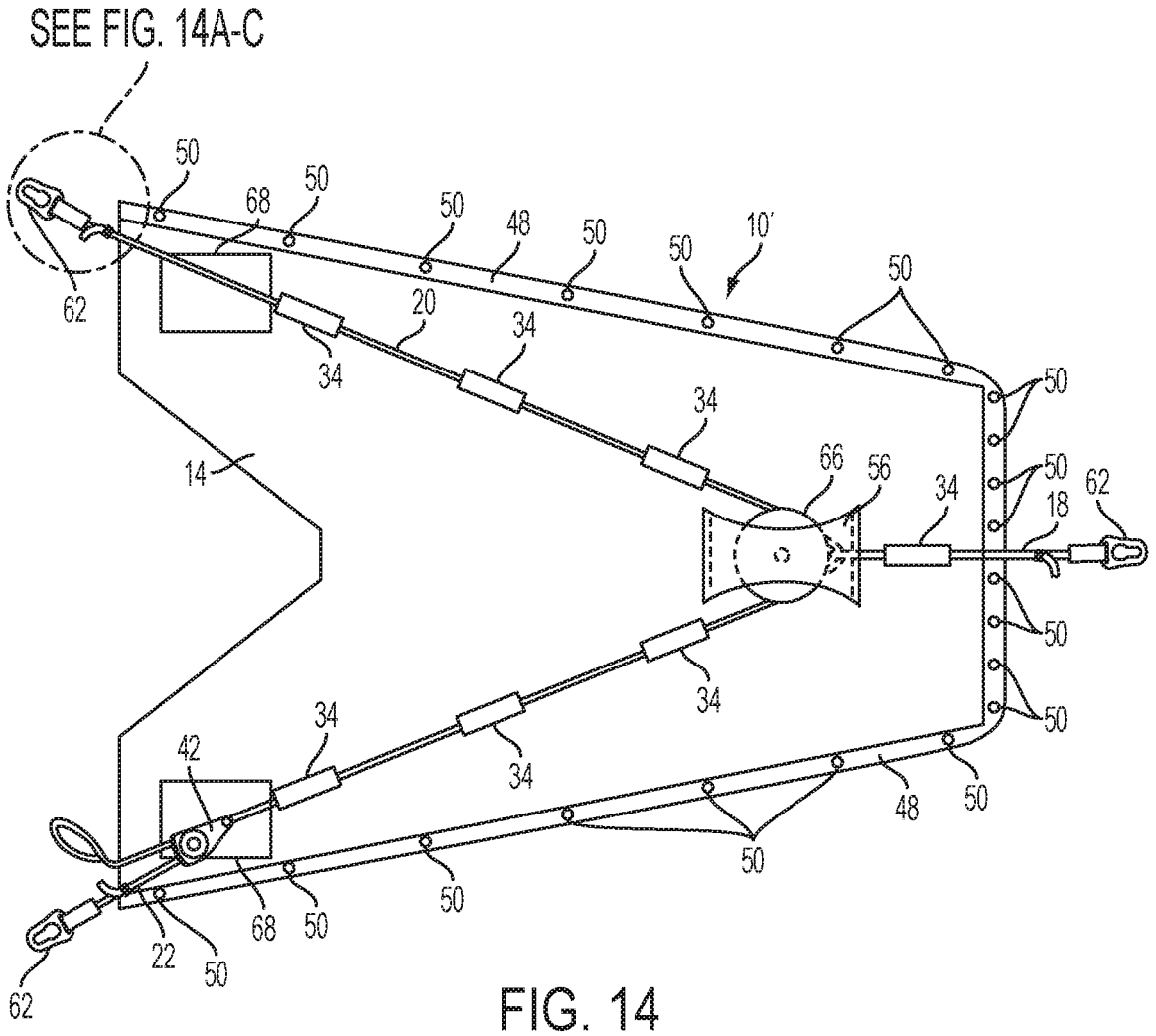
FIG. 14 is a bottom plan view of an alternative embodiment of a cover.

As previously described, one end of each of the series of ropes, for example, the first, second and third ropes 18, 20, 22 are secured to the bow and stern corners of the vehicle, respectively, by a fastener. Although many fasteners are known and can be used without departing from the spirit of the invention, the embodiment shown illustrates a DowcoLok® quick connect button and web clip. For example, as seen in FIG. 13, the first strap 18 is engaged with the ratchet 42 and has a one end connected to a web clip 62, for attaching the first strap to the bow of the boat 12. FIG. 14 similarly shows a web clip 62 attached to the second rope 20 and latched onto a DowcoLok® quick connect button 64 thereby connecting the cover 10 to the boat 12. The straps or ropes can be attached to the devices for securing a strap to a vehicle and/or the spreader plate 16 by the use of, for example, ladder locks as seen in FIG. 11, or any other known means for attaching a strap or rope to another object, for example a knot.

The sleeve 34 or loop 38 closest to the fastener for securing the strap to the vehicle can be sized such that it will not allow the fastener and rope to pull through the sleeve or loop. Such a configuration prevents the straps from having to be rethread through the sleeves 34 or loops 38, prevents the straps from becoming tangled and generally keeps the cover 10 in condition for use.

As previously mentioned, the tensioning means could also be located above the fabric cover material 14. For example, if it is not desirable to use the windshield 26 of the boat 12, the tensioning means could be attached to another elevated structure such as a Bimini, radar arch, towing tower, etc. In such an embodiment, a spreader plate 16 may not be necessary as the first, second and third ropes 18, 20, 22, could be attached to one another in a desired configuration. A clip, hook, carabineer or other known means for attaching to such a structure could be used to attach the series of ropes to the radar arch, for example, which allows the series of ropes to move as the cover 10 is tightened. Then, the first rope 18 could be attached to the bow of the boat 12, the second and third ropes 20, 22 attached to the stern corners of the boat and the ratchet 42 used to tighten the cover 10 down. The radar arch or other supporting structure would need to be strong enough to support the downward pull of the tensioned cover 10.

Figure 14A:
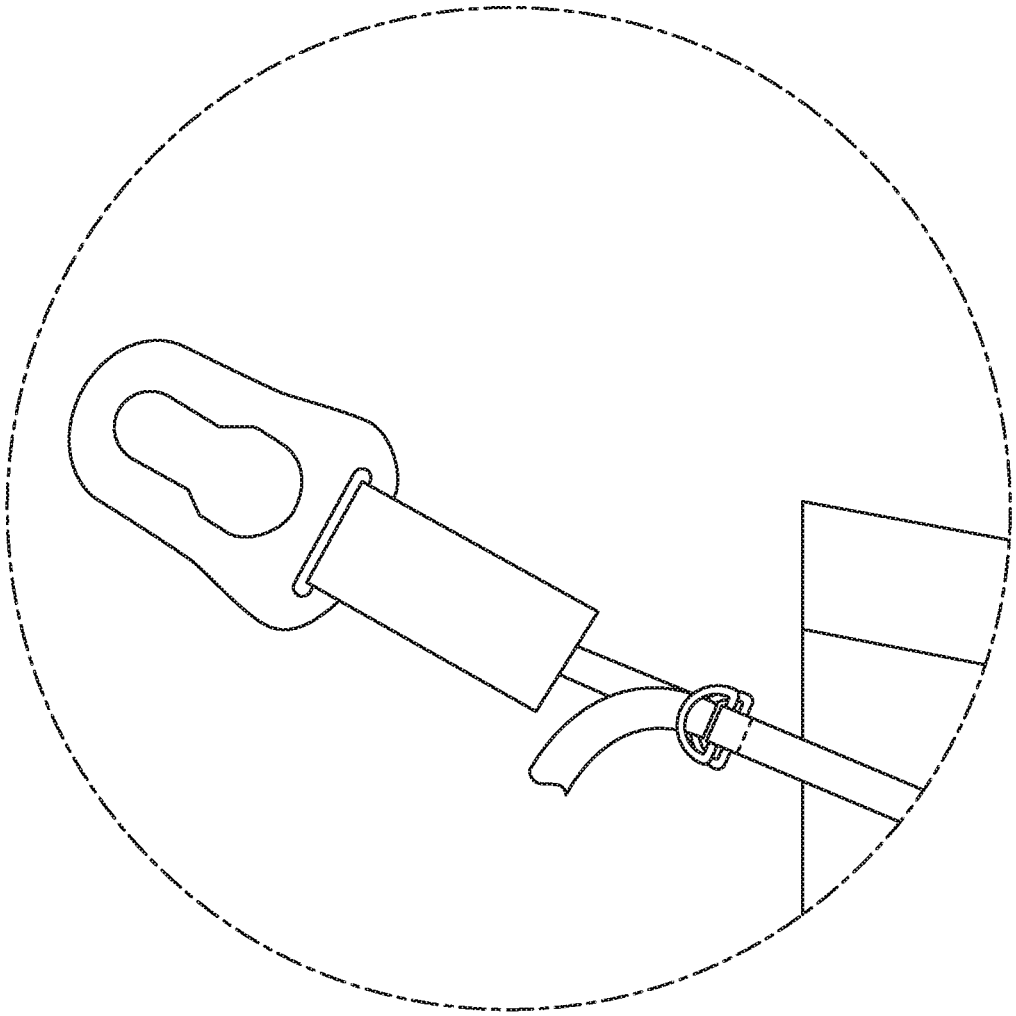
FIG. 14A is an enlarged bottom plan view of a portion of the cover of FIG. 14 indicated by the line 14A showing on example of a tightening mechanism known in the prior art.
Figure 14B:
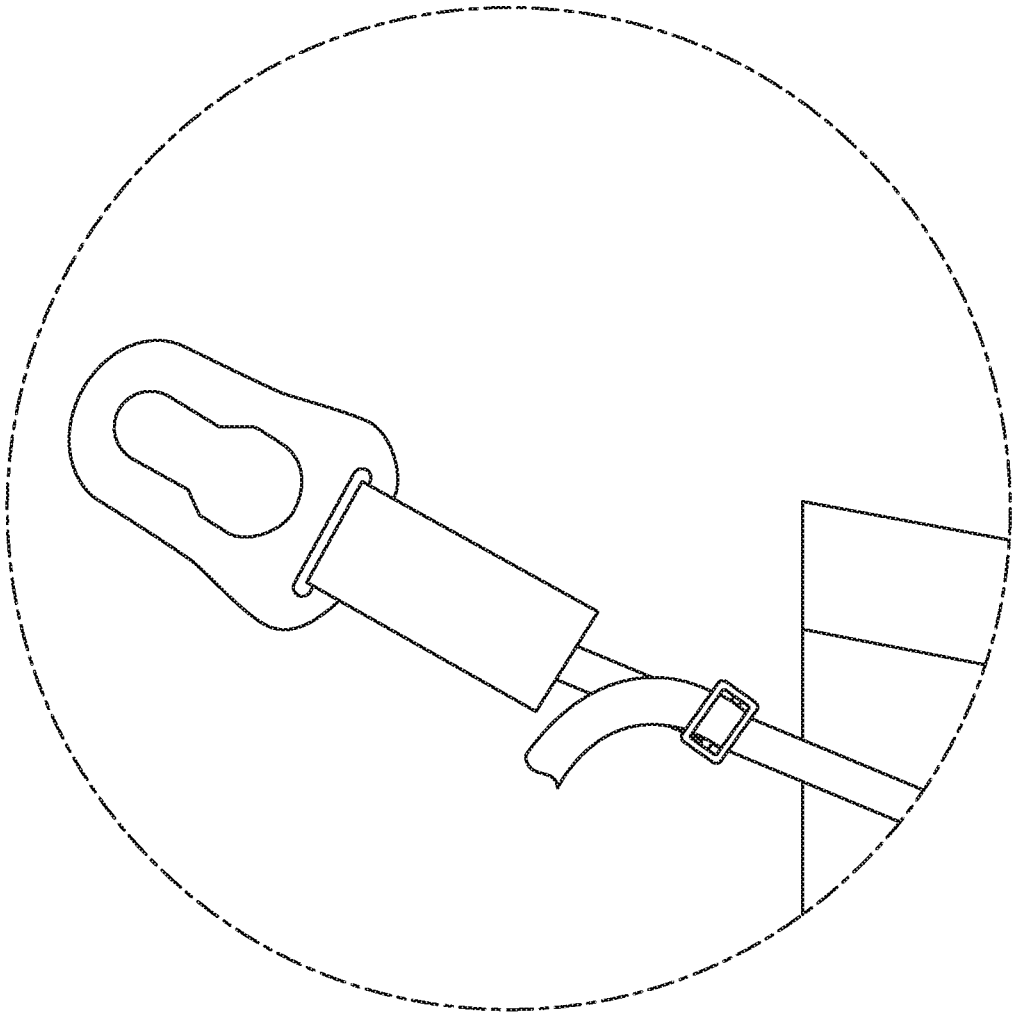
FIG. 14B is an enlarged bottom plan view of a portion of the cover of FIG. 14 indicated by the line 14A showing on example of an alternative tightening mechanism known in the prior art.
Figure 14C:
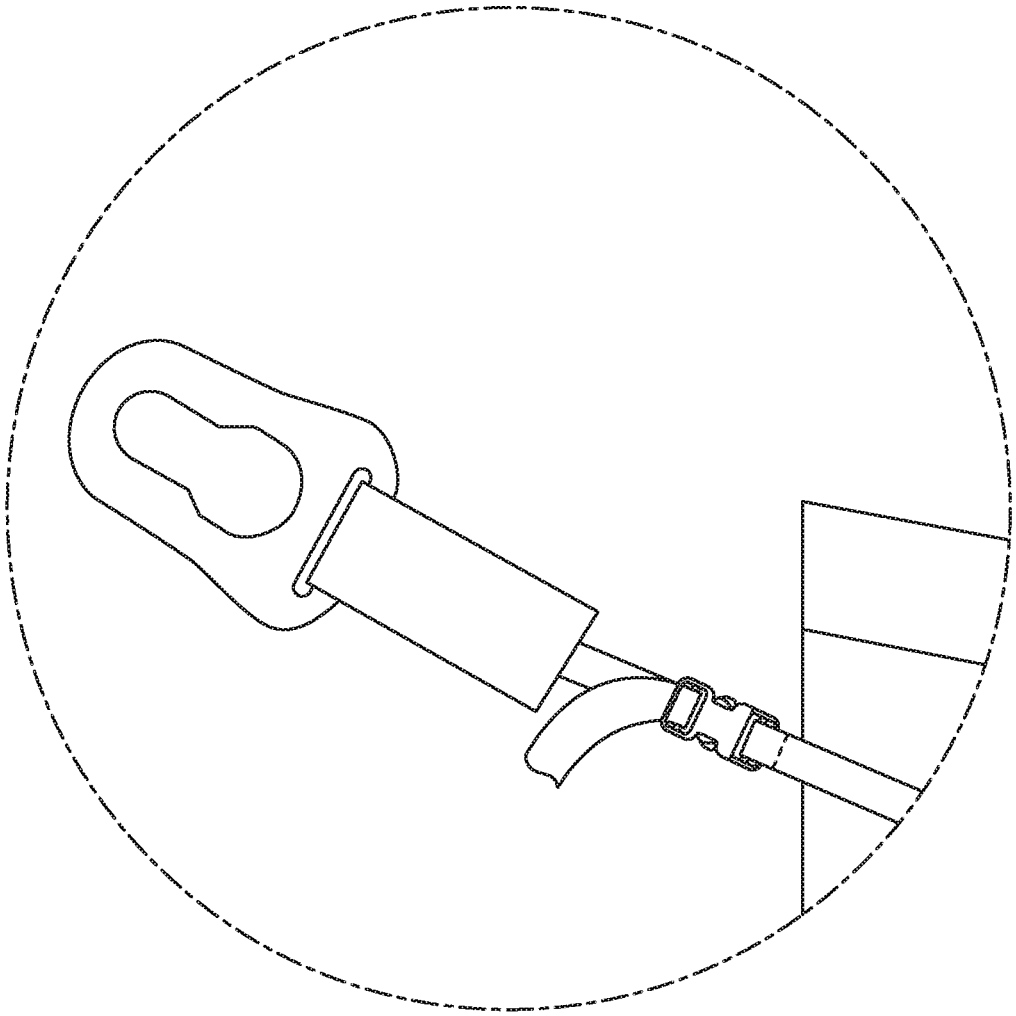

In another embodiment, the spreader plate 16 can be replaced with a pulley 66 as seen in FIG. 14. The first rope 18 can be attached at one end to a fixed support of the pulley 66 and at a second end to the bow of the boat 12. The pulley 66 can be connected or joined to the fabric cover material 14 by any known means such as, for example, by being enclosed in a pocket 56 in which the supports of the pulley are in a fixed relationship with the pocket. A second rope 20 can be attached at one end to one stern corner of the boat 12, in the example shown, the stern starboard corner, extend up to and around the pulley 66 and then back towards the stern port corner where its second end is attached to a tightening mechanism, for example a ratchet 42. The ratchet 42 can then have a third rope 22 that extends through the ratchet and is attached to the stern port corner. As seen in FIG. 14, and more specifically in FIGS. 14A-14C, additional tightening mechanisms may be included, for example, on the opposite end of the second rope 20.

As the third rope 22 is pulled through the ratchet 42, the distance between the stern port corner of the boat 12 and the ratchet becomes shorter. As the ratchet 42 is pulled towards the rear port corner of the boat 12, the first and second ropes 18, 20 are tightened or tensioned thereby giving the cover 10 support and form.

The ratchet 42 shown in FIG. 14 can be accessed through an access panel 68. Because the ratchet 42 and access panel 68 are located at a rear corner of the boat 12, the ratchet can be easily accessed when the boat is at a dock or on a boat lift. The ratchet 42 and second and third ropes 20, 22 can be attached to the boat 12 such that the ratchet is positioned at either rear corner of the boat.

Figure 15:
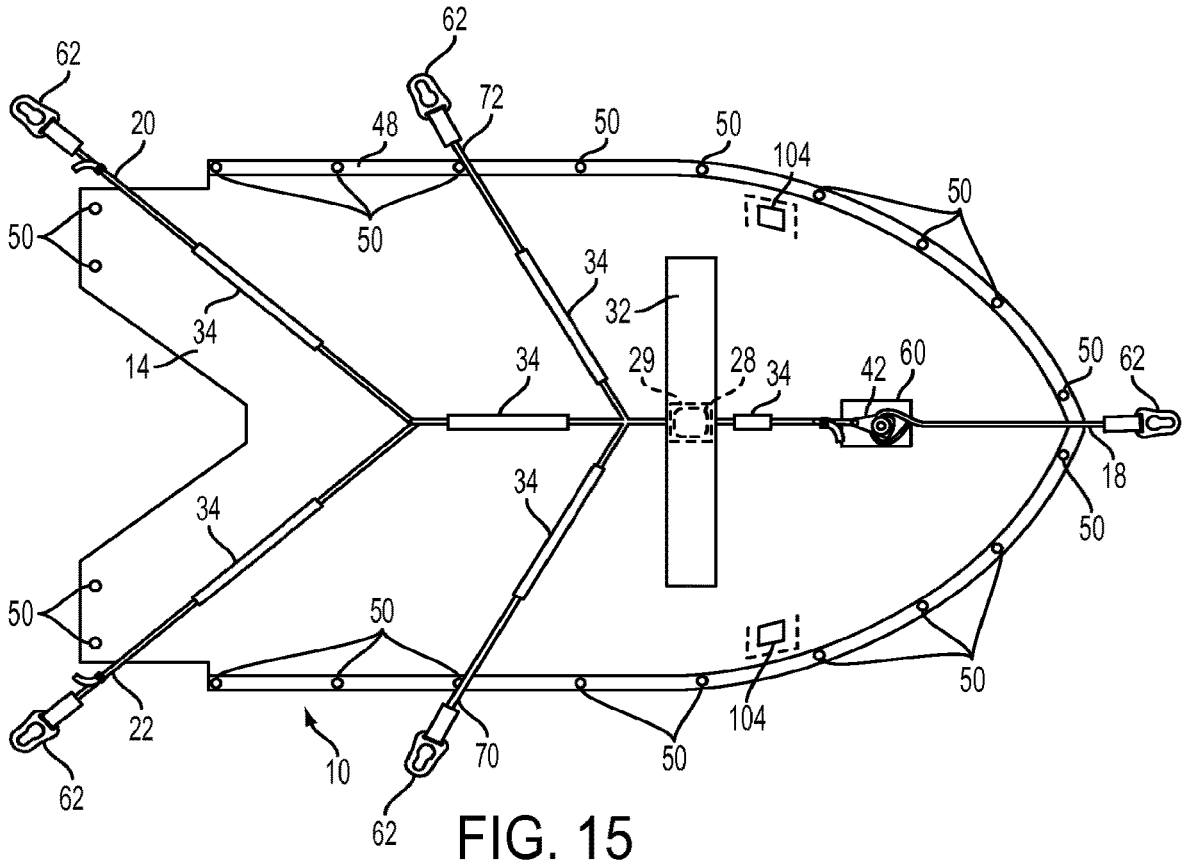
FIG. 15 is a bottom plan view of an alternative embodiment of a cover.

In another embodiment seen in FIG. 15, the tensioning means can include a first strap 18 that connects to the bow or nose of the boat 12 and continues through a number of sleeves 34, or other such means, down the middle of the fabric cover material 14. At a point near the stern of the boat 12 a second and third strap 20, 22, extend from the end of the first strap 18, through at least one sleeve 34 or loop 38, to the stern starboard and port corners, respectively. Additional straps, such as straps 70, 72, can also be used to further hold the cover 10 to the boat 12 and provide alternative forms to the cover as desired.

In another embodiment, it may not be desired to cover the bow of the boat 12. For example, for boats with a trolling motor mount 74 on the bow, a cover that encloses the bow of the boat would require that the trolling motor be taken off the mount before the cover 10 can be installed on the boat. The cover 10', in an alternative embodiment seen in FIG. 16, may not cover the bow of the boat 12 and instead just cover the footwell portion of the boat, thereby protecting the interior of the boat from exterior elements. In the cover embodiment shown in FIG. 16, the first rope 18 is attached to the bow of the boat 12 through the use of a web clip 62 that is connected to a DowcoLok® quick connect button 64 secured to the bow. The cover 10' may be attached to the stern corners of the boat 12 and use a tightening mechanism as previously described. The front of the cover 10' can use a series of snaps 50 that mate with a series of snaps 88 on the bow of the boat to prevent the front of the cover 10' from lifting up, such as, for example, when being towed, and from water thereby gaining access to the interior of the boat.

The bow of a boat 12 is typically a small, relatively flat area and thus, does not necessarily need a cover that can be tensioned. Further, as long as proper access is provided to the motor mount 74, a cover for the bow does not necessarily need to be taken on and off for each use.

Figure 16:
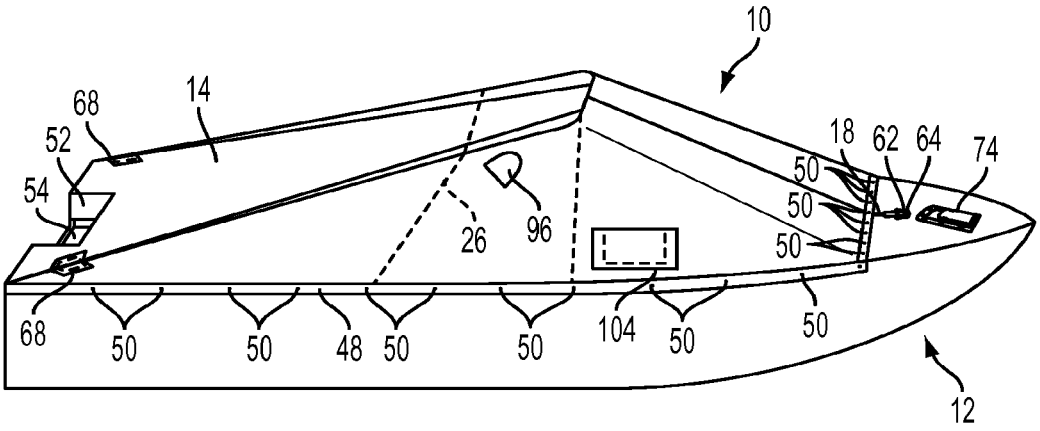
FIG. 16 is a perspective view of the cover from FIG. 14 installed on a boat.
Figure 17:
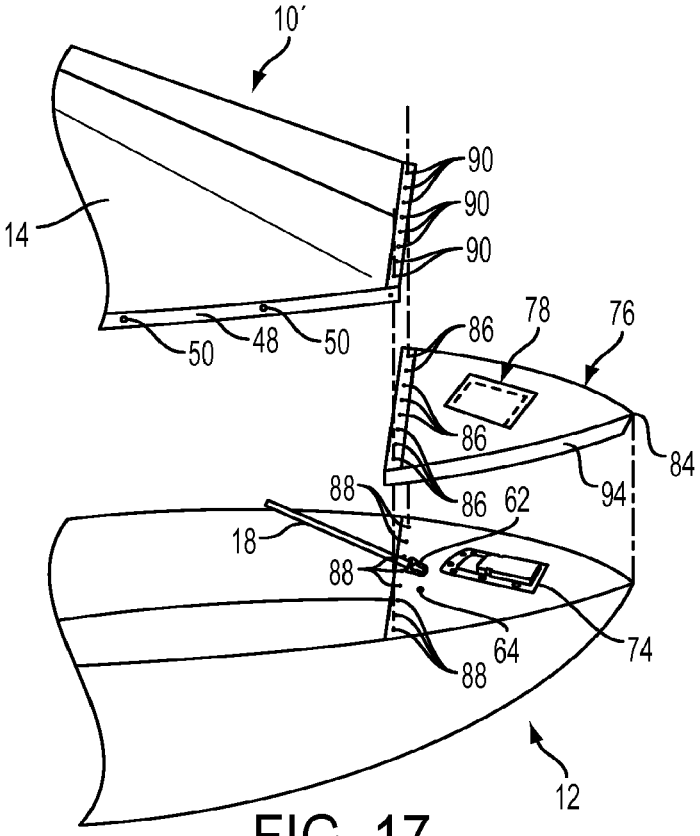
FIG. 17 is an enlarged, exploded perspective view of a bow cover and boat cover attached the bow of the boat of FIG. 16.
Figure 18:
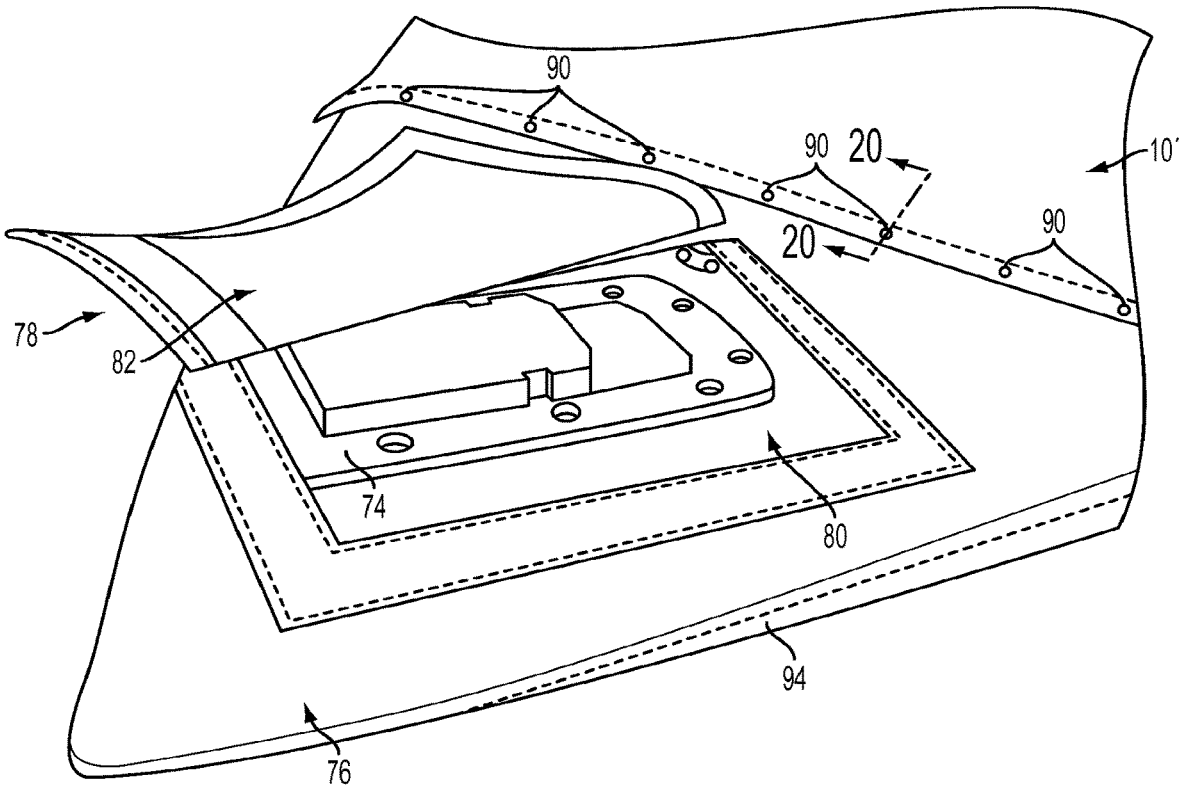
FIG. 18 is an enlarged perspective view of the bow cover in FIG. 17 with the motor mount panel open.

In one embodiment, seen in FIG. 17, a bow cover 76 can be shaped and sized to fit the bow of a boat 12. As seen in FIG. 16, the bow cover 76 can have a motor access panel 78 to provide quick and easy access to the motor mount 74. As seen in FIG. 18, the bow cover 76 can have a motor access opening 80, sized and shaped to allow access to the motor mount 74, and a motor access flap 82 that can be closed and opened, such as for example by hooks and loops, snaps, zippers, buttons, or other releasable closers known in the art. In the example shown in FIG. 18, the motor access flap 82 is sewn to the bow cover 76 adjacent one side of the motor access opening 80 to prevent the motor access flap from being lost or misplaced. The motor access opening 80 is surrounding on the remaining three sides by a material with loops that correspond to the three sides of the motor access flap 82 which has hooks. If access to the motor mount 74 is desired, the motor access flap 82 can be pulled back to expose the motor mount. Once a motor is mounted to the motor mount 74, the motor access panel 78 can remain open in which the bow cover 76 can protect the rest of the bow from exposure such as rain and/or sun.

A motor access panel 78 could also be provided on a full length cover 10. Alternatively, the bow cover 76 or full cover 10 could include a slit 83 from the motor access panel 78 to an adjacent side of the bow cover or full cover. The slit 83 would allow the bow cover 76 or full cover 10 to be added and removed from the boat 12 even with a trolling motor attached to the motor mount 74. The slit 83 could include releasable closure means such as hooks and loops, snaps, zippers, buttons, etc., to allow the slit to be open and closed when desired.

Figure 19:
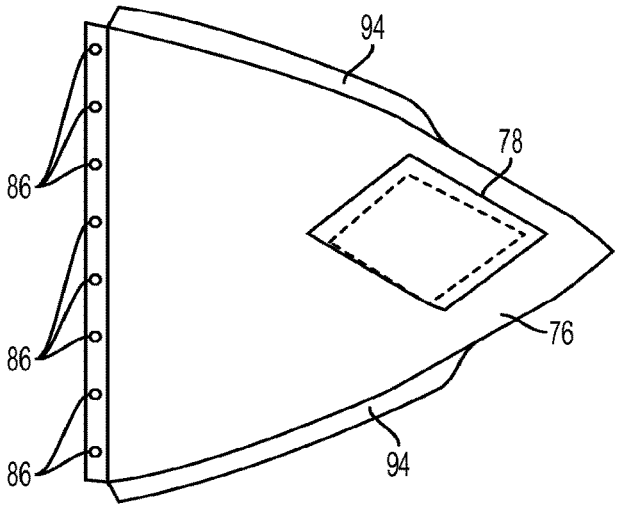
FIG. 19 is a top plan view of the bow cover from FIG. 16 uninstalled.
Figure 20:
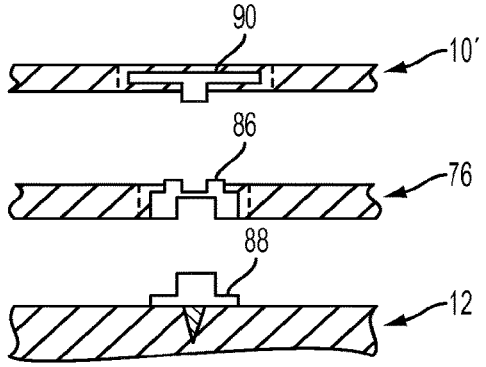
FIG. 20 is an exploded cross section view of the connection between a boat, bow cover and boat cover taken along the line 20-20 in FIG. 17.

The bow cover 76 embodiment shown in FIG. 19 includes a nose pocket or enclosure 84 which fits over the nose of the boat 12 and a series of snaps 86, such as gypsy studs, on the side opposite the nose pocket. As seen in FIG. 20, the snaps 86 are designed so that the underside of the snap 86 can mate with the snap 88 on the bow of the boat 12, and the topside can accept a mating piece 90 attached to the cover 10'. Thereby, both the cover 10' and the bow cover 76 are secured to the boat 12. There are other means for attaching both a bow cover and a cover to a boat, such as, for example, hooks and loops or grommets, which are known in the industry, the use of which would not defeat the spirit of the invention.

Figure 21:
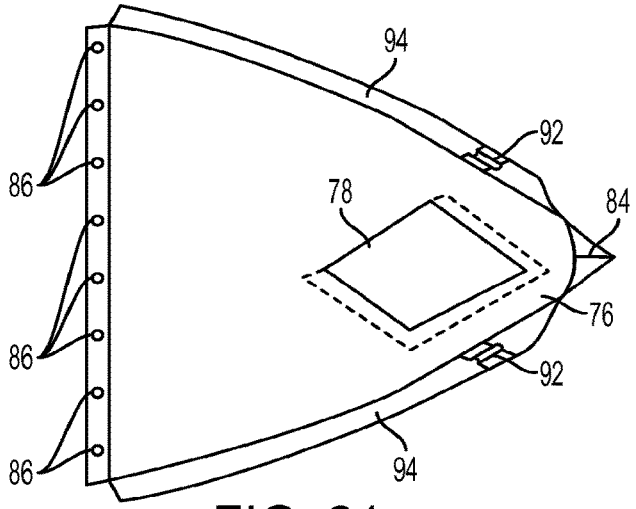
FIG. 21 is a bottom plan view of the bow cover from FIG. 16 uninstalled.
Figure 22:
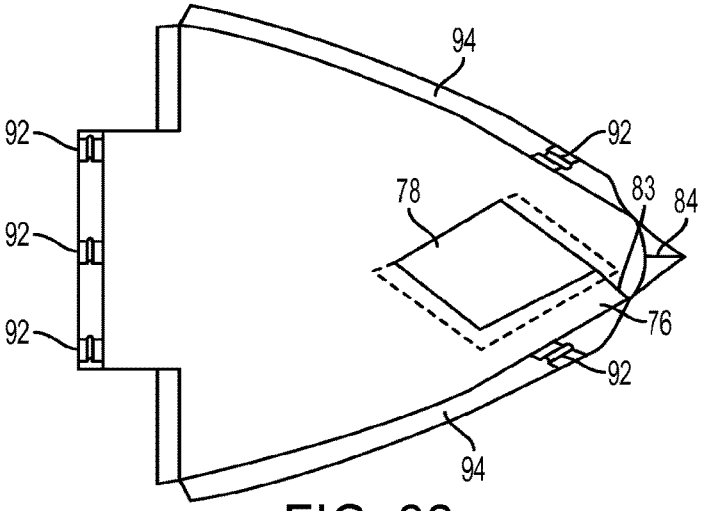
FIG. 22 is a bottom plan view of an alternative embodiment of a bow cover uninstalled.

The bow cover 76 can also include a number of fasteners for further securing the bow cover to the boat. In the example shown in FIG. 21, first and second side flaps or skirts 94 of the bow cover 76 can have at least one fastener, for example, a resilient cover clip 92, attached to each skirt, such as by sowing. One example of a resilient cover clip is disclosed in U.S. patent application Ser. No. 14/606,735, which is hereby incorporated by reference herein in its entirety for all purposes. The resilient cover clips 92 can attach to a channel 36 of a gunnel rail 40 of a boat 12 to further secure the bow cover 76 to the boat. Similarly, the third side, the side opposite the nose pocket 84, could be extended, as seen in FIG. 22, and include at least one fastener which could attach to a channel inside the footwell on the bow wall (not shown). Similarly, the perimeter flap 48 of the cover 10' could use resilient cover clips 92, or other closures such as snaps, to further secure the cover to the boat 12.

The boat cover 10 may also include a nose or bow pocket or enclosure 106 as seen in FIGS. 1 and 5 and/or stern corner pockets 108 as seen in FIGS. 1, 3 and 5. The bow pocket 106 and stern corner pockets 108 can be made from an elastic material so that the pockets can be put on the boat 12 and used to hold the fabric cover material 14 in place while the cover 10 is further installed.

Figure 23:
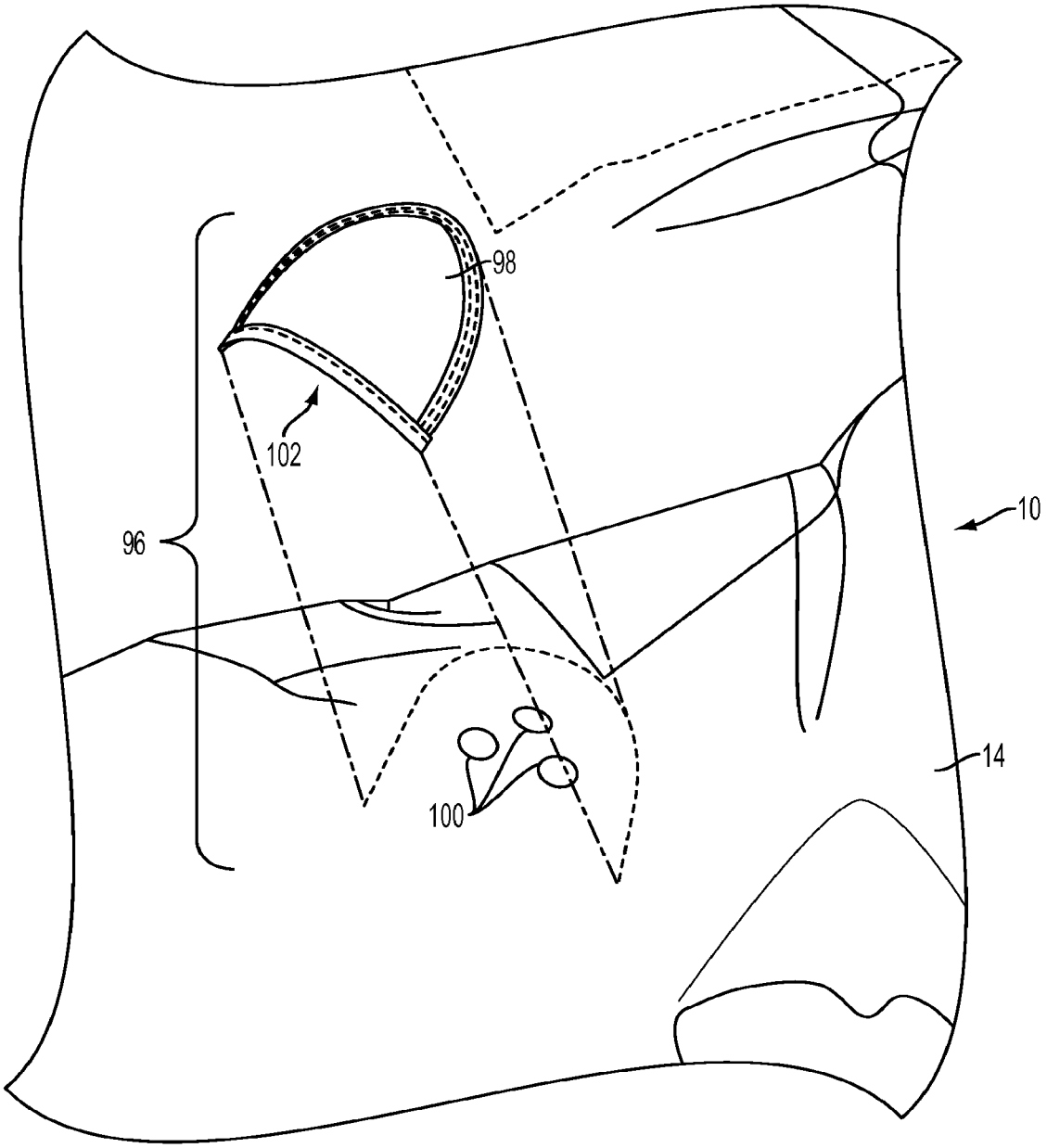
FIG. 23 is an enlarged, exploded perspective view of a vent of FIG. 3 taken along the line 23-23.

Often a cover is put on a boat 12 after the boat has been used. This can mean that the footwell of the boat includes a lot of moisture and may even be wet from, for example, occupants getting out of the water and into the boat. It is therefore desirable to draw the moisture out of the boat 12. To this end, the cover 10 may also include one or more vents 96. As seen in the vent embodiment in FIG. 23, the vent 96 can include a vent cap 98 and one or more vent openings 100 through the cover 10. The shape, size and location of the vents 96, as may also be seen in FIGS. 1-3, create a vacuum at the mouth 102 of the vent when the boat 12 with cover 10 is pulled behind a vehicle, e.g. being towed. When a vacuum is created, air is drawn out of the interior of the boat 12 thereby helping to draw moisture out of the boat. The vacuum also helps the cover 10 to more snuggly fit or conform to the contours of the boat 12, thereby making the boat with cover more aerodynamic and fuel efficient to tow and prevents the cover from flapping in the wind, which can damage the cover.

Figure 24:
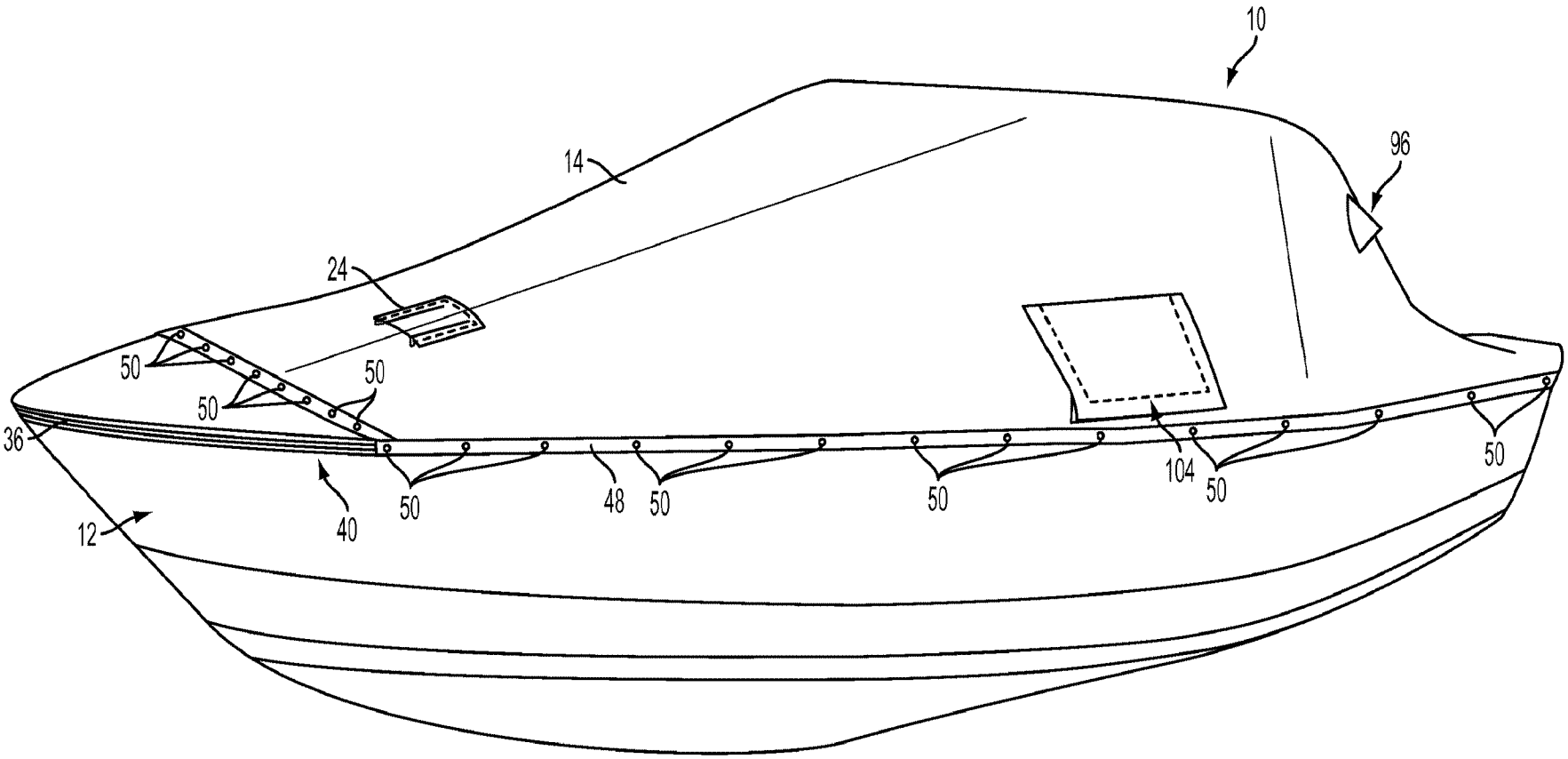
FIG. 24 is a enlarged, perspective view of an accessory panel of FIG. 2 taken along the line 24-24.

Accessory panels can also be included on the cover 10 for access to other features and structures of the boat 12. As seen in FIG. 24, an accessory panel 104 is located to provide access to a cleat of the boat 12. If it is desired to tie the boat 12 to a dock with the cover 10 on, the accessory panel 104 can be opened to provide access to the cleat for docking. Similarly, accessory panels could be provided for any number of features, such as access to fueling (e.g. a fuel tank), an interior compartment, electronics (e.g. radio), etc. For example, the motor access panel 80 is also a type of accessory panel.

Although the invention has been herein described in what is perceived to be the most practical and preferred embodiments, it is to be understood that the invention is not intended to be limited to the specific embodiments set forth above. For example the tensioning means has been described and shown as being attached to the fabric cover material. However, the tensioning means could be separate from the fabric cover material without defeating the spirit of the invention. The tensioning means could be loosely attached to the boat, the fabric cover material then secured to the boat and the tensioning means tightened thereby giving form and shape to the cover. It is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A covering for a vehicle with an elevated structure, the covering comprising:

a fabric sized to cover at least a portion of the vehicle;

a securing means coupled to the fabric and configured to be attached to the vehicle for securing the fabric to the vehicle; and a tensioning means coupled to the fabric, the tensioning means further comprising a tightening mechanism, the tightening mechanism located on an underside of the fabric for creating a generally taut fabric;

wherein, the tightening mechanism is configured to be accessible when the fabric is secured to the vehicle; and wherein, when the fabric is taut, the fabric forms generally inclined surfaces with low points where the fabric is secured to the vehicle and at least one high point at the elevated structure such that water will run off the fabric and at least one side of the vehicle.

2. The covering of claim 1 wherein the securing means comprises a plurality of sleeves connected to the fabric and at least one rope that extends through some of the plurality of sleeves and is configured to be connected by at least one end to the vehicle.

3. The covering of claim 2 wherein the plurality of sleeves are located below the fabric.

4. The covering of claim 2 wherein the securing means further comprises a second rope that extends through some of the plurality of sleeves and is configured to be connected by at least one end to the vehicle.

5. The covering of claim 1 wherein the tightening mechanism comprises a structure selected from a group consisting of a ratchet, a winch, gearing a pulley, a buckle and rings.

6. The covering of claim 1 further comprising a guard connected to the fabric and is configured to be positioned over the elevated structure to reduce damage to the elevated structure from the covering.

7. The covering of claim 1 wherein the tensioning means comprises:

a first rope configured to be attached to a front portion of the vehicle; and a second rope having a first end attached to a first corner of a rear portion of the vehicle and a second end attached to a second corner of the rear portion of the vehicle;

wherein the first rope is engaged to the second rope.

8. The covering of claim 7 wherein the first rope is engaged to the second rope by the tightening mechanism.

9. A vehicle covering comprising:

a cover material;

a first rope attached to the cover material, the first rope having a first end configured to be attached to a vehicle at a first location such that at least a portion of the first rope extends over at least a portion of a top of the vehicle;

a second rope attached to the cover material, the second rope having a first end configured to be attached to the vehicle at a second location and a second end configured to be attached to the vehicle at a third location, such that at least a portion of the second rope extends over at least a portion of the vehicle; and a set of rings directly engaged with one of the first rope or second rope configured to tighten the first rope and second rope to give form to the cover material such that water will run off the cover material.

10. The vehicle covering of claim 9, further comprising:

a pocket formed in the cover material; and a plate located in the pocket to attach the plate to the cover material;

wherein a second end of the first rope is attached to the plate.

11. The vehicle covering of claim 9, wherein the cover material has a vent.

12. The vehicle covering of claim 9, wherein the cover material has a number of sleeves and at least one of the first rope or second rope extends through some of the number of sleeves.

13. The vehicle covering of claim 12, wherein at least one of the first rope or second rope is configured to be connected to the vehicle by a fastener and wherein at least one of the some of the number of sleeves is sized such that the fastener cannot fit though the least one of the number of sleeves.

14. The vehicle covering of claim 12, wherein the first location is a nose of a boat, the second location is a stern starboard corner of the boat and the third location is a stern port corner of the boat.

15. The vehicle covering of claim 14, wherein the cover material has a flap on at least one side and at least one closure attached to the flap for securing the cover material to the boat.

16. The vehicle covering of claim 9 wherein the first rope is attached to a ring and the second rope is attached to the first strap by extending through the ring.

17. The vehicle covering of claim 9 wherein the first rope is attached to the second rope and the set of rings is located adjacent a corner of a rear portion of the vehicle.

18. A covering for a boat with a windshield, the covering comprising:

a fabric sized to cover at least a portion of the boat;

a series of straps coupled to the fabric for securing the fabric to the boat; and a tightening device coupled to at least one of the series of straps;

wherein, when the at least one of the series of straps is taut, the fabric forms generally inclined surfaces with low points where the fabric is secured to the boat and at least one high point at the windshield such that water will run off the fabric and at least one side of the boat;

wherein the covering is configured to remain secured to the boat when the boat is removed from a trailer; and wherein the covering is configured to be selectively attached and removed from the boat when the boat is in the water.

19. The covering of claim 18 further comprising a pad attached to the fabric and configured to disperse a load from the at least one of the series of straps on the windshield when the at least one of the series of straps is taut.

20. The covering of claim 19, wherein the at least one of the series of straps is located between the fabric and the pad.

21. The covering of claim 18, wherein the tightening device is a buckle and the one of the series of straps is configured to be made taut by pulling on an end of the at least one of the series of straps extending out of the buckle.

22. The covering of claim 21 wherein the fabric has an accessory panel and wherein the accessory panel provides access to the buckle.

23. The covering of claim 18 further comprising:

a first sleeve connected to the fabric; and a second sleeve connected to the fabric;

wherein the series of straps comprises a first strap and a second strap; and wherein the first strap is coupled to the fabric by extending through the first sleeve and the second strap is coupled to the fabric by extending through the second sleeve.

24. The covering of claim 18 wherein the tightening device is located adjacent a corner of a rear portion of the boat when the covering is attached to the boat.

* * * * *